US005244295A

United States Patent [19]

Terashima et al.

[11] Patent Number: 5,244,295

[45] Date of Patent: Sep. 14, 1993

[54] PRINTING DEVICE HAVING A SOUND INSULATING WALL

[75] Inventors: Yuji Terashima, Mizuma; Shogo Horinouchi, Fukuoka; Yutaka Miyazono; Takashi Haruguchi, both of Kasuga; Kazumi Otsubo, Kurume, all of Japan

[73] Assignee: Matsushita Electric Industrial Co., Ltd., Osaka, Japan

[21] Appl. No.: 4,656

[22] Filed: Jan. 14, 1993

Related U.S. Application Data

[63] Continuation of Ser. No. 759,440, Sep. 13, 1991, abandoned.

[51] Int. Cl.[5] ..... B41J 13/036; B41J 29/08

[52] U.S. Cl. ..... 400/639; 400/690; 400/645

[58] Field of Search ..... 400/689-694, 400/719, 639, 639.1, 645, 638; 346/145; 181/201

[56] References Cited

U.S. PATENT DOCUMENTS

| | | | |
|---|---|---|---|
| 2,517,147 | 8/1950 | Vee | 400/690 |
| 3,122,228 | 2/1964 | Dollenmayer et al. | 400/690 |
| 4,560,295 | 12/1985 | Fujiwara et al. | 400/690.4 |
| 4,568,211 | 2/1986 | Fox et al. | 400/693 |
| 4,626,117 | 12/1986 | Dumuse | 400/690.1 |
| 4,943,173 | 7/1990 | Okazaki et al. | 400/689 |

FOREIGN PATENT DOCUMENTS

| | | | |
|---|---|---|---|
| 2706209 | 8/1978 | Fed. Rep. of Germany | 400/690.4 |
| 0155779 | 12/1981 | Japan | 400/689 |

*Primary Examiner*—Edgar S. Burr
*Assistant Examiner*—Christopher A. Bennett
*Attorney, Agent, or Firm*—Pollock, VandeSande & Priddy

[57] ABSTRACT

A dot-matrix impact printer includes a print head in a housing for printing a recording sheet fed around a platen. The recording sheet is pressed against the platen by a sheet presser roller. A roller cover or a flap is disclosed as a sound insulating wall closely to the sheet presser roller and has an edge held against the housing. The space above the print head is closed by the housing, the platen, the sheet presser roller, and the platen, so that the impact noise produced when the printer is in operation will not leak out of the housing, while at the same time the recording sheet fed around the platen is not blocked by the closure mechanism.

10 Claims, 12 Drawing Sheets

PRINTING DEVICE HAVING A SOUND INSULATING WALL

This application is a continuation of Ser. No. 07/759,440 filed on Sep. 13, 1991, now abandoned.

BACKGROUND OF THE INVENTION

1. Field of the Invention

The present invention relates to a printing device such as a dot-matrix impact printer, and more particularly to a silencing structure for such a printing device.

2. Description of the Prior Art

Printing devices are widely used as output hardcopy devices for personal computers, work stations, or the like.

Conventional printing devices, typically dot-matrix impact printers, produce impact noise while the print head is printing a recording sheet. The impact noise that is produced when the print wires strike the platen through the ink ribbon and the recording sheet passes between a sheet presser roller and an upper cover, and leaks out of the printer housing and the upper cover through a slot for discharging the printed recording sheet. Therefore, the noise level outside the printing devices is relatively high.

Furthermore, the conventional printing devices have no sheet guide downstream of the print head with respect to the direction in which the recording sheet is fed. Accordingly, the recording sheet tends to engage or be blocked by the lower surface of the upper cover, and may get jammed when it is inserted into the printing device and placed around the platen.

SUMMARY OF THE INVENTION

It is an object of the present invention to provide a printing device having a print head that is enclosed jointly by a platen, a sheet presser member, a sound insulating wall, and a housing for preventing impact noise produced during printing operation from leaking out of the housing to thereby lower the noise level outside the housing, the sound insulating wall doubling as a sheet guide that prevents a recording sheet of paper from being jammed when the recording sheet is inserted into the printing device and placed around the platen.

According to the present invention, a printing device includes a housing, a print head for printing a recording sheet, the print head being disposed in the housing, a platen for supporting the recording sheet, a sheet presser member for pressing the recording sheet against the platen, and a sound insulating wall disposed closely to the sheet presser member and having an edge held against the housing.

The space above the print head is closed by the housing, the platen, the sheet presser roller, and the platen. With such an arrangement, the impact noise produced when the printing device is in operation is substantially prevented from leaking out of the housing, while at the same time the recording sheet fed around the platen is not blocked by the closure mechanism.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
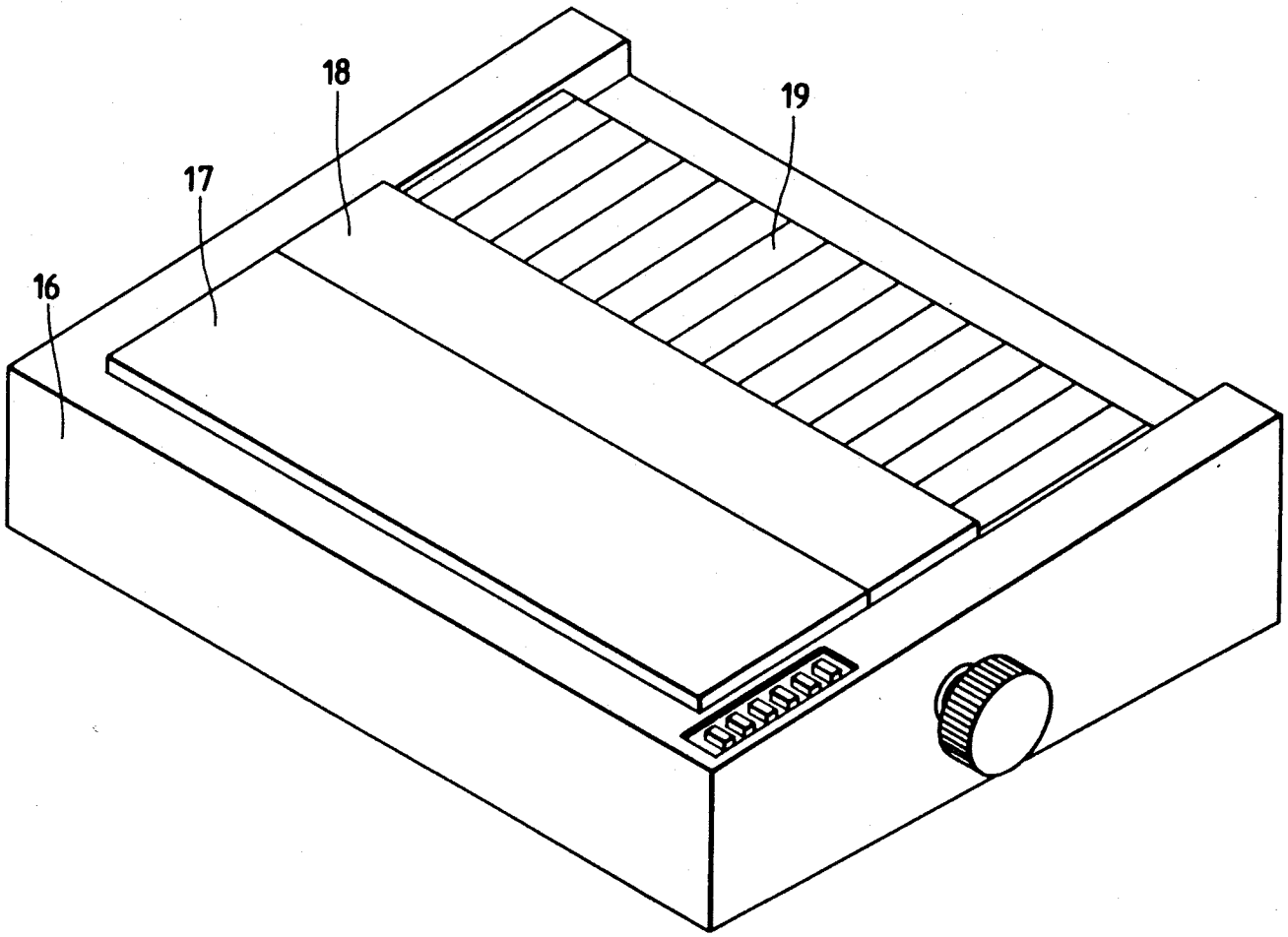
FIG. 1 is a perspective view of a printing device according to a first embodiment of the present invention.

Like or corresponding parts are denoted by like or corresponding reference characters throughout views.

FIGS. 1 through 6 show a printing device, typically a dot-matrix impact printer, according to a first embodiment of the present invention.

Figure 2:
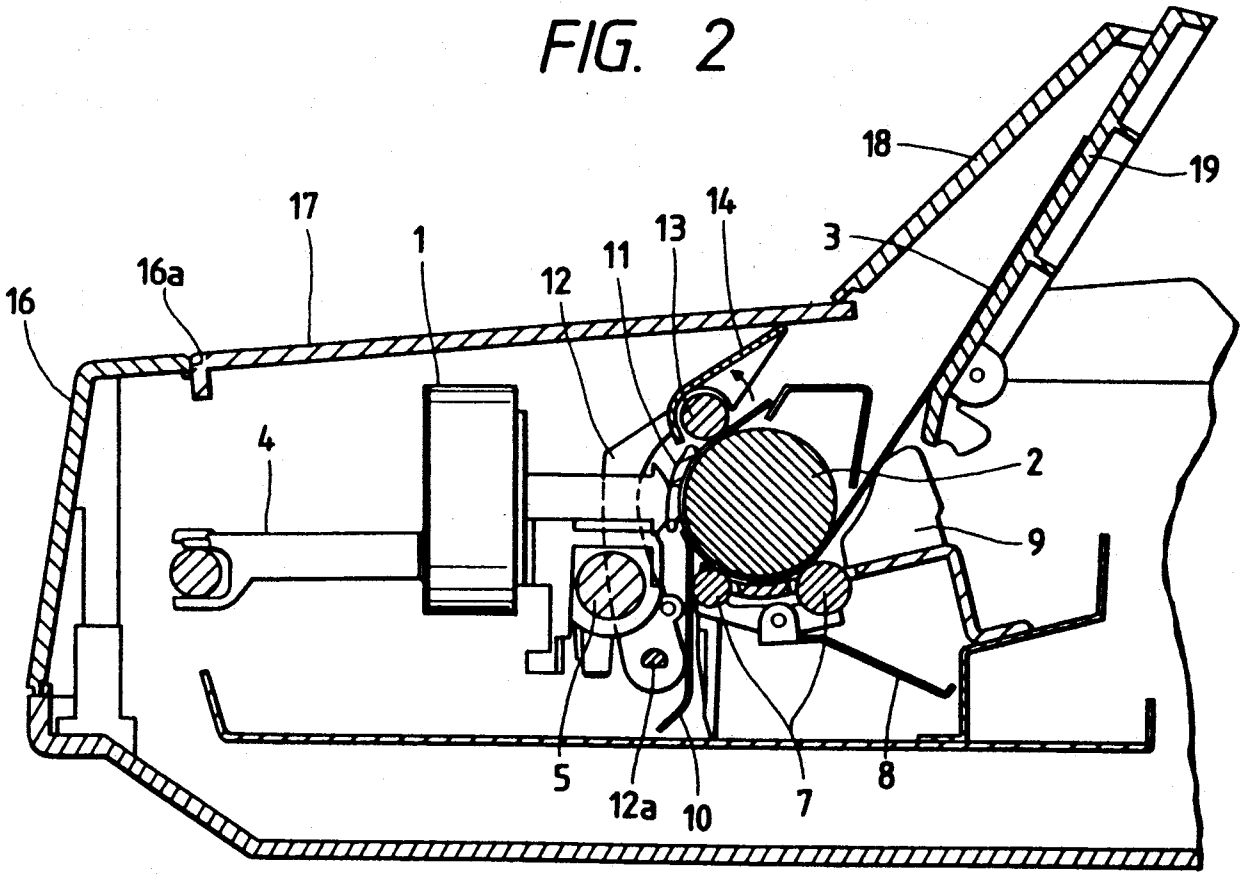
FIG. 2 is a fragmentary vertical cross-sectional view of the printing device according to the first embodiment.
Figure 3:
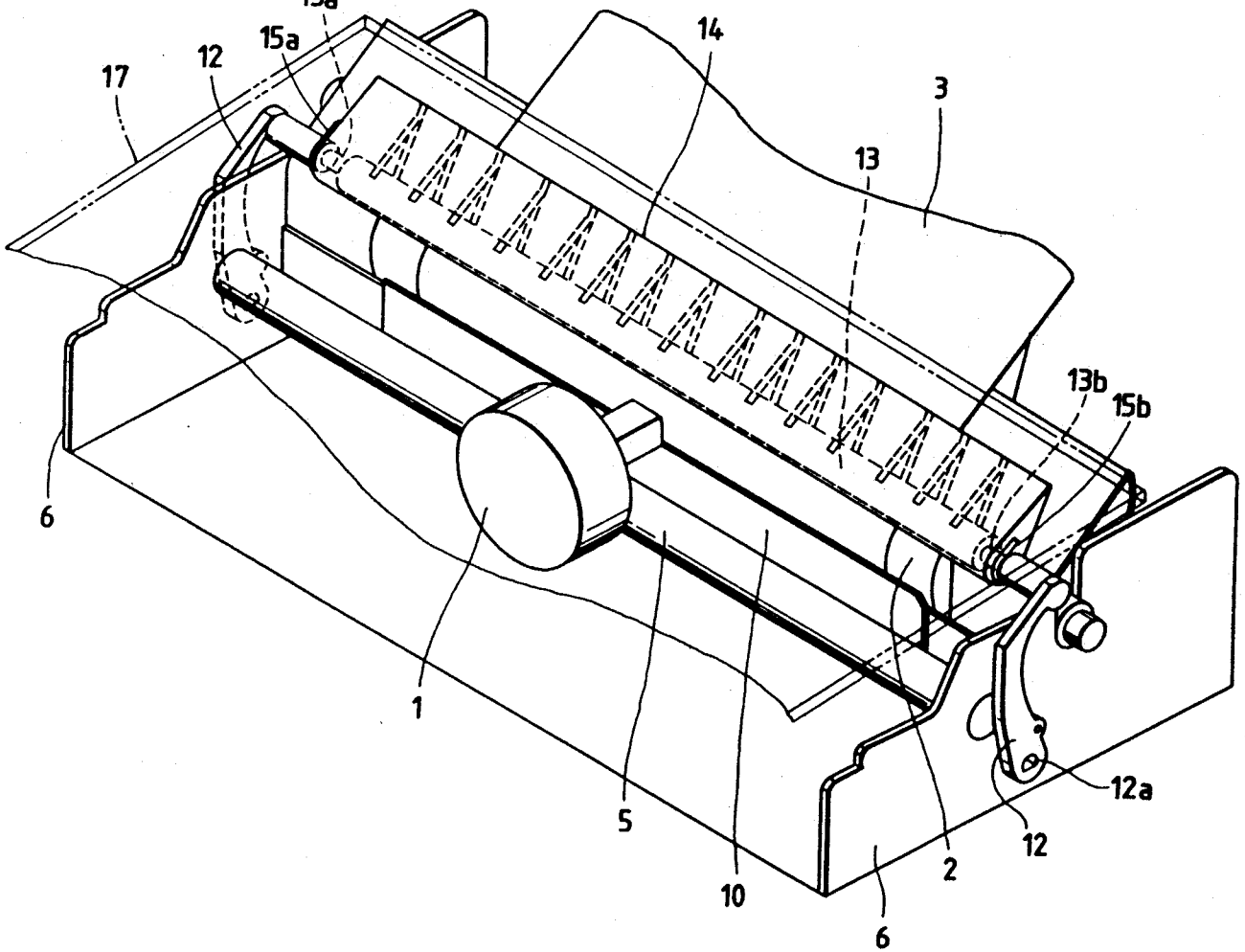
FIG. 3 is a fragmentary perspective view of an internal structure of the printing device according to the first embodiment.

As shown in FIGS. 1 through 3, the printing device has a print head 1 incorporating a plurality of solenoids for driving print wires, and a cylindrical platen 2 for supporting and feeding a recording sheet 3 of paper. The cylindrical platen 2 is disposed in confronting relationship to the print head 1, and bears impact when the print wires strike the platen 2 through an ink ribbon (not shown) and the recording sheet 3. The print head 1 is mounted on a carriage 4 that is supported on and movable along a carriage shaft 5 parallel to the platen 2.

Figure 4:
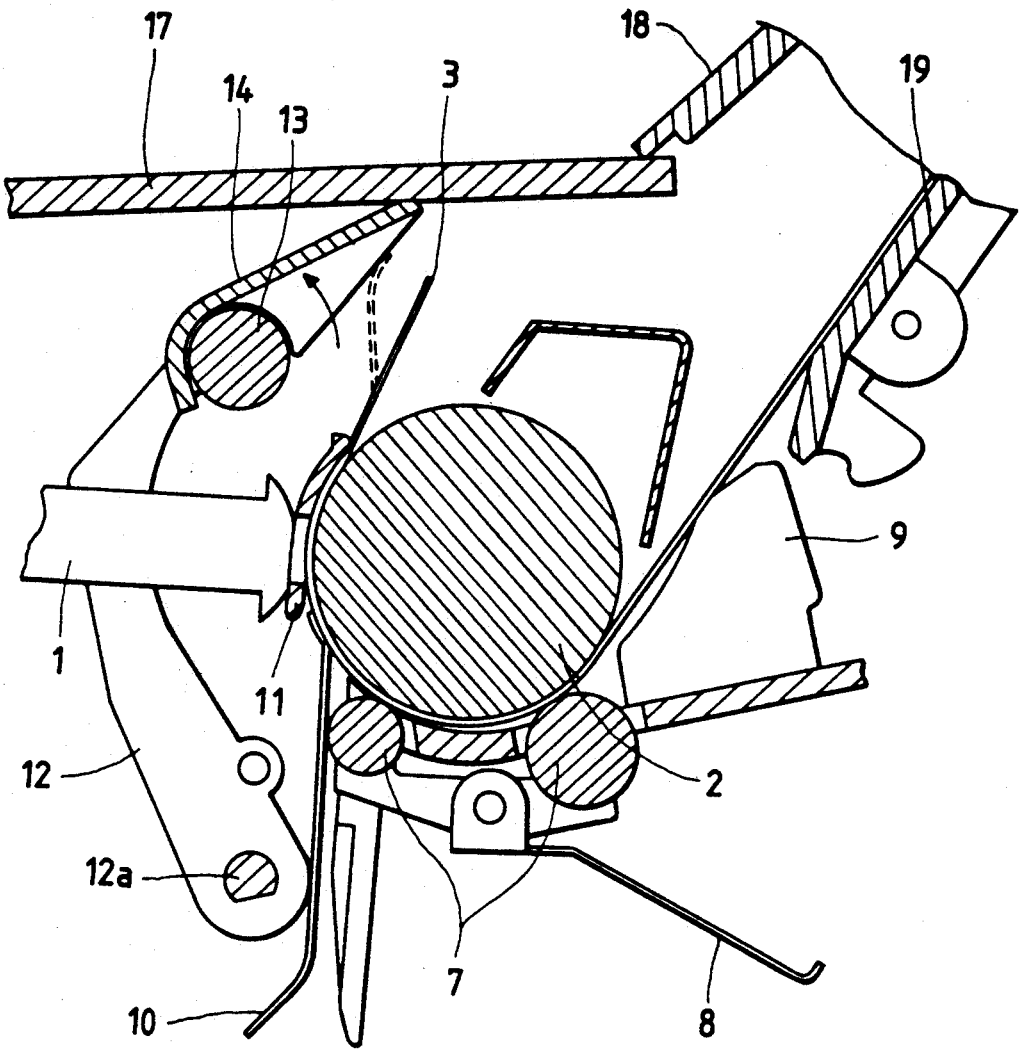
FIG. 4 is an enlarged fragmentary vertical cross-sectional view of the printing device according to the first embodiment, showing a sheet presser roller in an inoperative position.
Figure 5:
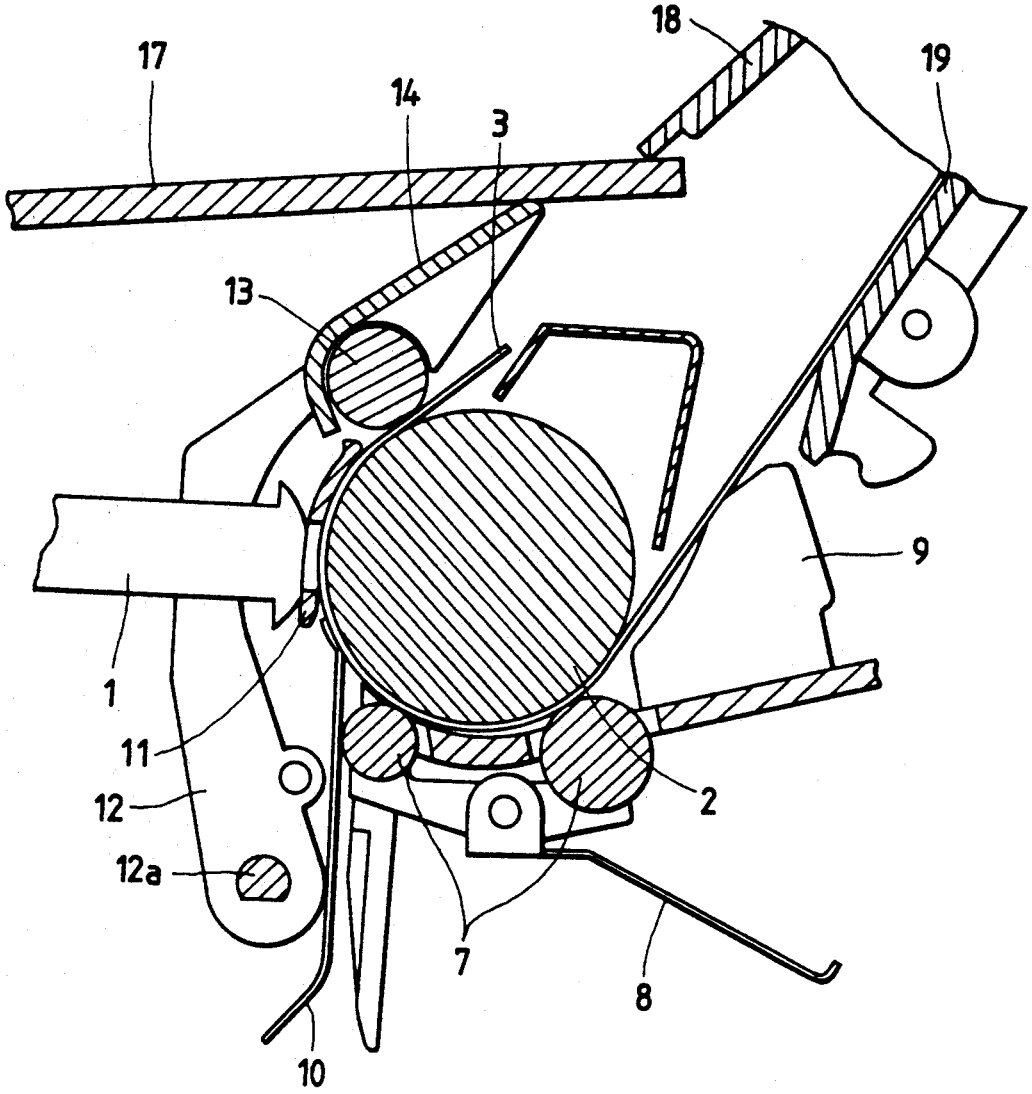
FIG. 5 is an enlarged fragmentary vertical cross-sectional view of the printing device according to the first embodiment, showing the sheet presser roller in an operative position.

Sheet feed idler rollers 7 extend parallel to the platen 2 and are normally resiliently biased against the platen 2 by a spring 8. The sheet feed idler rollers 7 can be displaced away from the platen 2 against the bias of the spring 8 by a release lever (not shown). When the sheet feed idler rollers 7 are resiliently urged toward the platen 2, the recording sheet 3 is sandwiched between the platen 2 and the sheet feed idler rollers 7, and is fed along by the platen 2 as it rotates. The recording sheet 3 is guided along the platen 2 by a sheet guide 9 while it is being fed by the rotating platen 2. The recording sheet 3 is held against the platen 2 by a sheet presser 10 whose upper distal end is normally resiliently biased against the platen 2 by a spring (not shown). The recording sheet 3 is also held against the platen 2 at a print position by a sheet holder 11 that is fixed to the carriage and disposed near the tip end of the print head 1. A cylindrical sheet presser roller 13 parallel to the platen 2 is rotatably supported on upper ends of a pair of support arms 12. The support arms 12 are angularly movably supported on a printer chassis 6 (FIG. 3) for angular movement about lower shafts 12*a* thereof. When the recording sheet 3 is to be inserted into the printing device and placed around the platen 2, each support arm 12 is turned counterclockwise to displace the sheet presser roller 13 into an inoperative position away from the platen 2, as shown in FIG. 4. After the recording sheet 3 is placed around the platen 2, each support arm 12 is turned clockwise to displace the sheet presser roller 13 into an operative position in which the sheet presser roller 13 normally presses the recording sheet 3 against the platen 2 under the bias of a spring (not shown), as shown in FIG. 5.

The print mechanism, which is composed of the print head 1, the platen 2, and other components, as described above, is accommodated in an outer casing 16 that has an upper opening 16*a*. The upper opening 16*a* of the outer casing 16 is covered with an upper cover 17. The outer casing 16 and the upper cover 17 jointly serve as a housing. The upper opening 16*a* is also partly covered with a sound insulating cover 18 that is positioned rearwardly of the upper cover 17 and angularly movably supported thereon. The printing device also has an angularly movable sheet stand 19 disposed behind the sound insulating cover 18, for guiding the recording sheet 3 into the printing device.

The sheet presser roller 13 is fully covered with a roller cover 14 that is disposed closely to and extends fully over the sheet presser roller 13, the roller cover 14 serving as a sound insulating wall. The roller cover 14 is angularly movably supported at its opposite ends on opposite ends 13*a*, 13*b* (FIG. 3) of the sheet presser roller 13. The roller cover 14 is normally urged upwardly against the lower surface of the upper cover 17 by springs 15*a*, 15*b* attached to the respective support arms 12.

The printing device according to the first embodiment operates as follows: As shown in FIG. 4, the recording sheet 3 is inserted along the sheet stand 19 and the sheet guide 9 between the platen 2 and the sheet feed idler rollers 7, and is sandwiched between the platen 2 and the sheet feed idler rollers 7. When the platen 2 rotates, the inserted recording sheet 3 is fed along the outer circumference of the platen 2 into a position between the platen 2 and the sheet presser roller 13 while being guided by the sheet presser 10 and the sheet holder 11. At this time, the sheet presser roller 13 is in the inoperative position away from the platen 2, and the roller cover 14 is limited in its angular movement by stoppers (not shown) on the respective support arms 12, so that the roller cover 14 serves as a guide for the recording sheet 3. After the recording sheet 3 is thus placed around the platen 2, the support arms 12 are turned clockwise toward the platen 2, as shown in FIG. 5, and the sheet presser roller 13 presses the recording sheet 3 against the platen 2.

With the recording sheet 3 held against the platen 2 by the sheet feed roller 13, the print wires of the print head 1 are selectively actuated to press the ink ribbon against the recording sheet 3, thereby printing desired characters on the recording sheet 3. During the printing operation, the sheet presser roller 13 is in the operative position, and the roller cover 14 is held against the upper cover 17 under the bias of the springs 15*a*, 15*b* shown in FIG. 3. Therefore, the space above the print head 1 and below the upper cover 17 is closed by the outer casing 16, the upper cover 17, the sheet presser roller 13, the platen 2, and the roller cover 14, which jointly constitute a closure mechanism, while at the same time the recording sheet 3 is allowed to be fed along without interference with the closure mechanism.

When the recording sheet 3 is inserted in the printing device and placed around the platen 2, the recording sheet 3 is guided by the roller cover 14 so as not to engage the upper cover 17. The recording sheet 3 can thus be fed along reliably and smoothly without a jam. While the print head 1 is in operation, impact noise is produced when the print wires of the print head 1 strike the platen 2 through the ink ribbon and the recording sheet 3. However, since the space above the print head 1 and be low the upper cover 17 is closed by the outer casing 16, the upper cover 17, the sheet presser roller 13, the platen 2, and the roller cover 14, as described above, the produced impact noise is substantially prevented from leaking out of the outer casing 16 and the upper cover 17. Therefore, the level of noise outside the printing device is greatly reduced.

Figure 6:
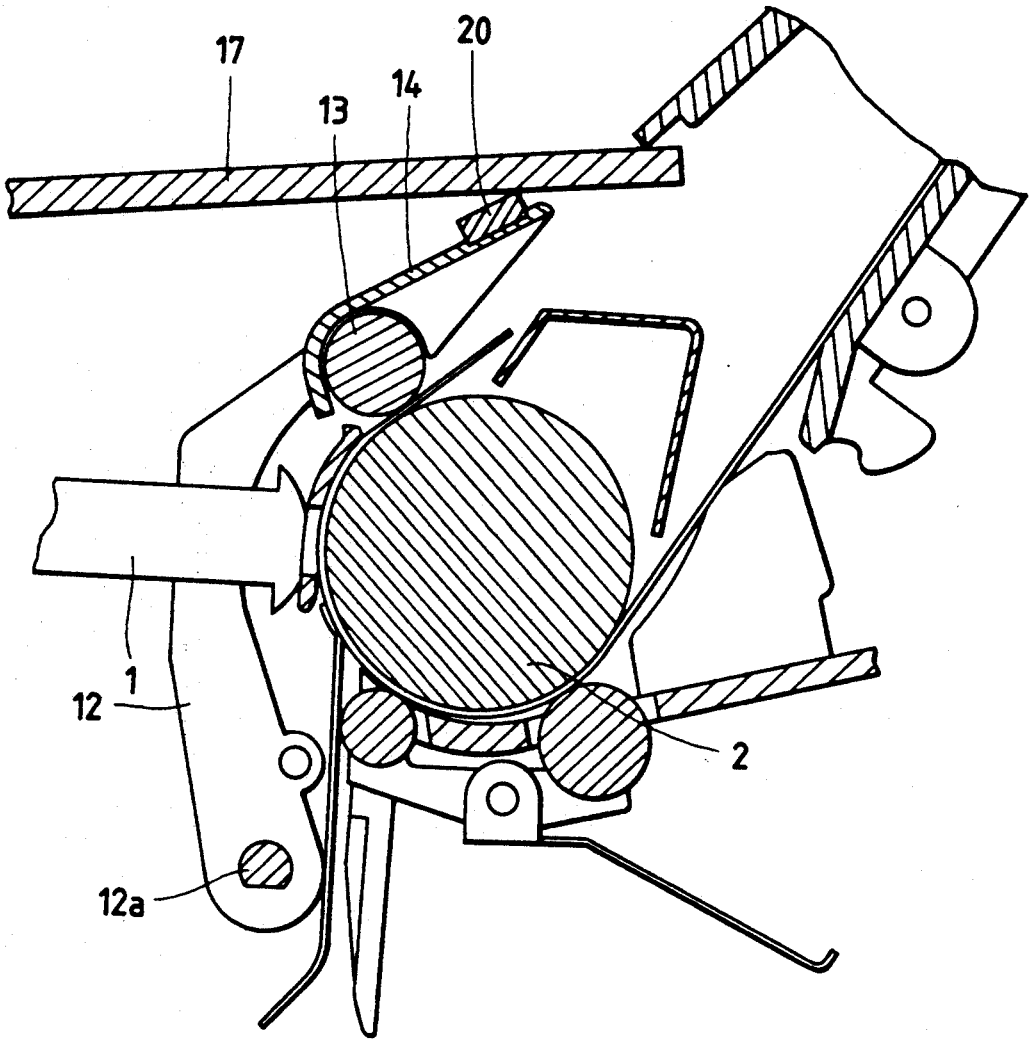
FIG. 6 is an enlarged fragmentary vertical cross-sectional view of a modification of the printing device according to the first embodiment, showing a slide member mounted on a roller cover.

When the sheet presser roller 13 is displaced between the operative and inoperative positions, the upper edge of the roller cover 14 slides against the lower surface of the upper cover 17. As shown in FIG. 6, a slide member 20 such as of felt may be mounted on the roller cover 14 for smooth sliding contact with the upper cover 17. Alternatively, the upper edge of the roller cover 14 may be coated with a fluoroplastic layer for smooth sliding contact with the upper cover 17. With such a modification, the sheet presser roller 13 can smoothly switch between the operative and inoperative positions while at the same time keeping the space above the print head 1 fully enclosed against noise leakage.

A printing device according to a second embodiment of the present invention will be described below with reference to FIGS. 7 through 10.

Figure 7:
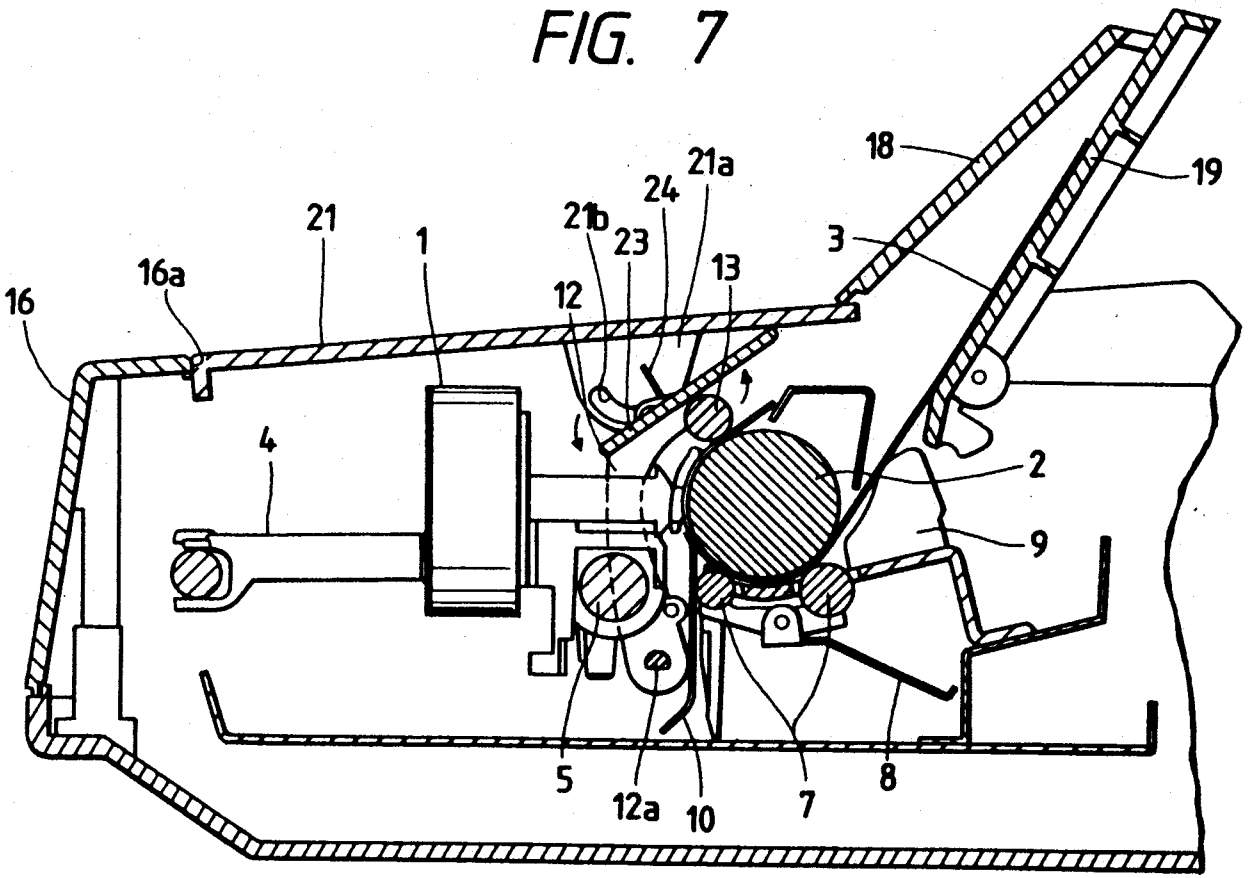
FIG. 7 is a fragmentary vertical cross-sectional view of the printing device according to a second embodiment of the present invention.
Figure 8:
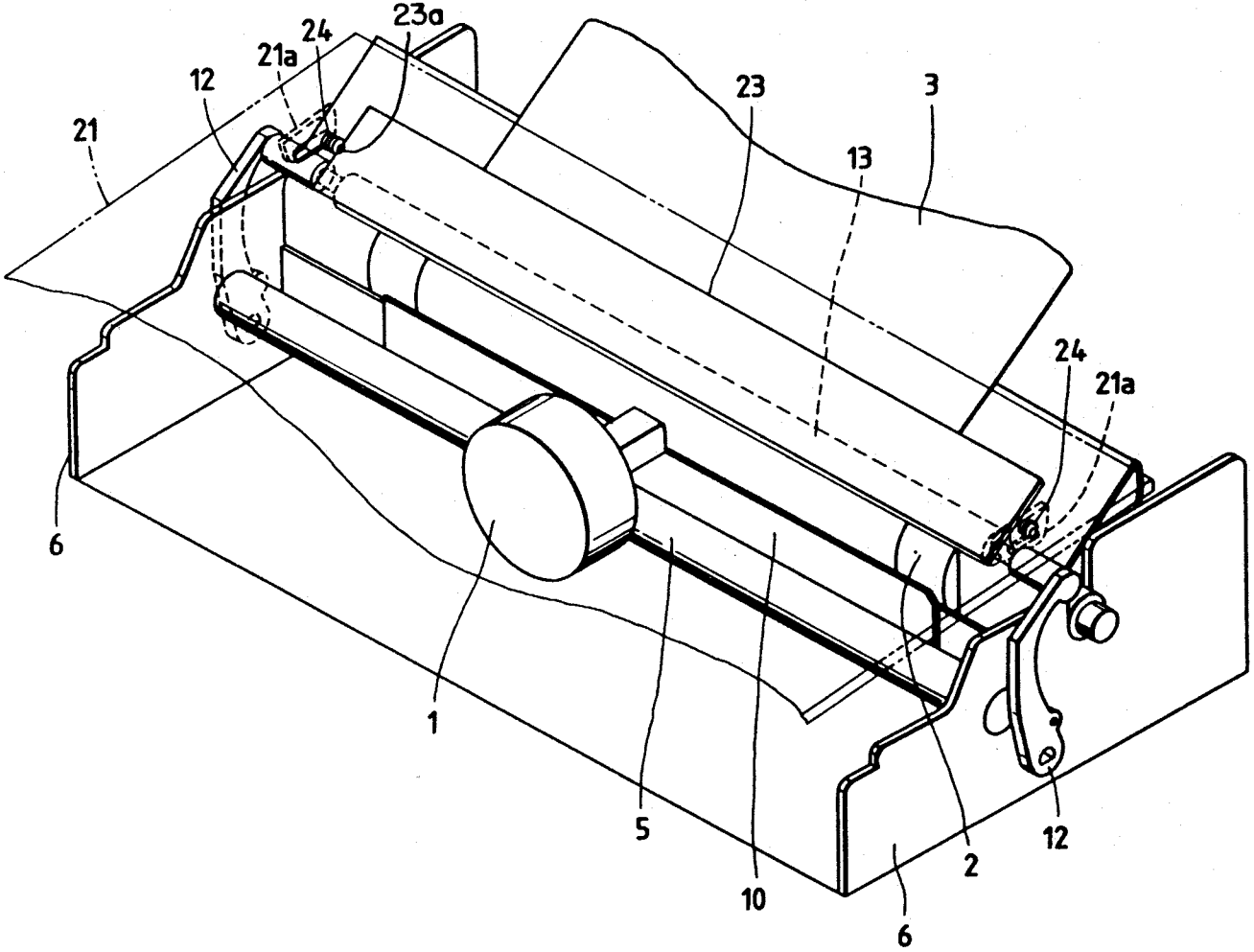
FIG. 8 is a fragmentary perspective view of an internal structure of the printing device according to the second embodiment.

As shown in FIG. 7 and 8, the printing device according to the second embodiment differs from the printing device according to the first embodiment in that the upper opening 16*a* of the outer casing 16 is covered with an upper cover 21 that has two spaced lugs 21*a* positioned on its respective sides and projecting downwardly. The lugs 21*a* have respective arcuate slots 21*b* defined therein. A flap 23 which is disposed beneath the upper cover has pins 23*a* projecting on the opposite ends thereof and slidably supported in the respective arcuate slots 21*b* so that the flap 23 is angularly movably supported on the lugs 21*a*. The flap 23, serving as a sound insulating wall, is normally urged to turn counterclockwise (FIG. 7) toward the sheet presser roller 13 by springs 24 acting between the flap 23 and the lugs 21*a*, with the upper edge of the flap 23 being urged against the upper cover 21.

Figure 9:
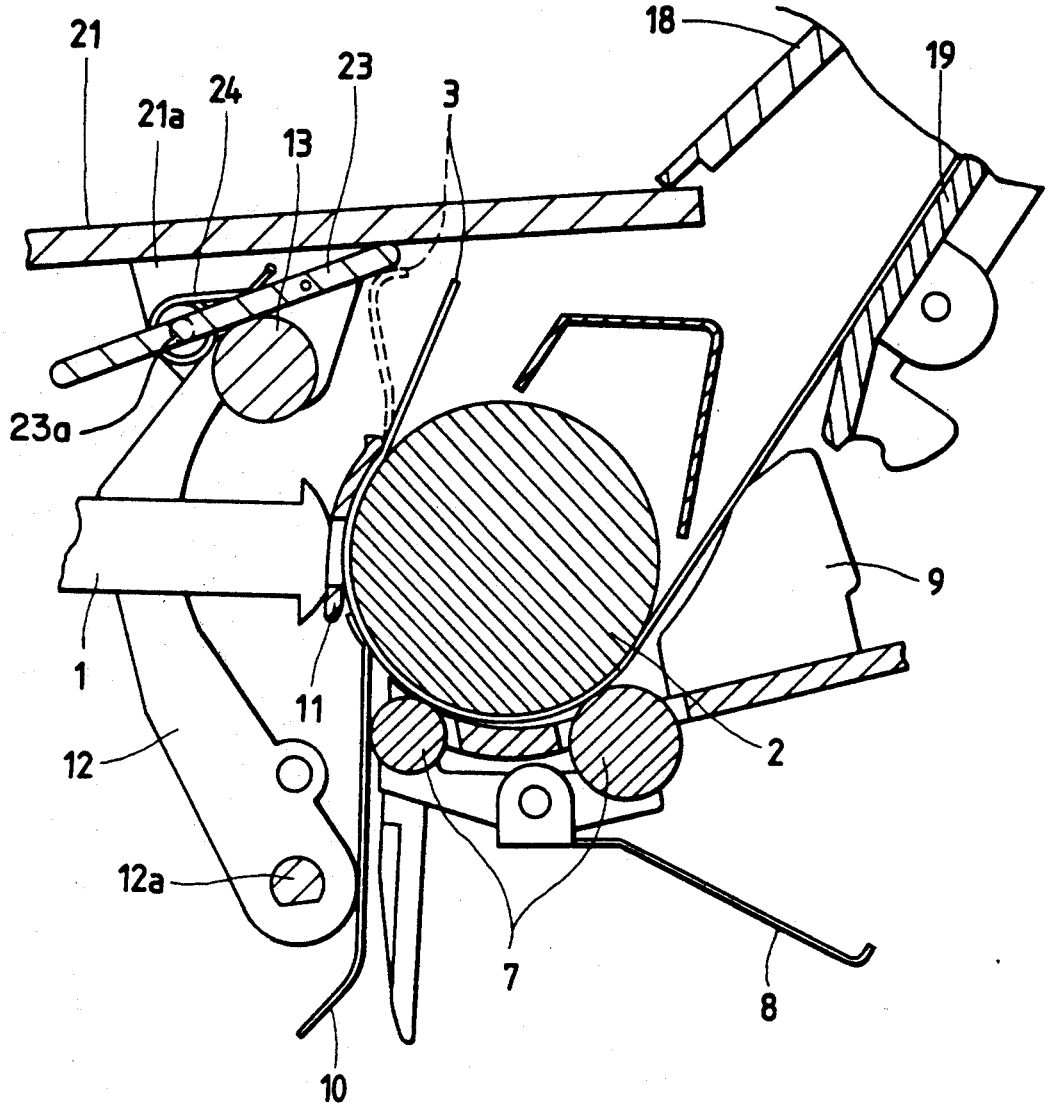
FIG. 9 is an enlarged fragmentary vertical cross-sectional view of the printing device according to the second embodiment, showing a sheet presser roller in an inoperative position.
Figure 10:
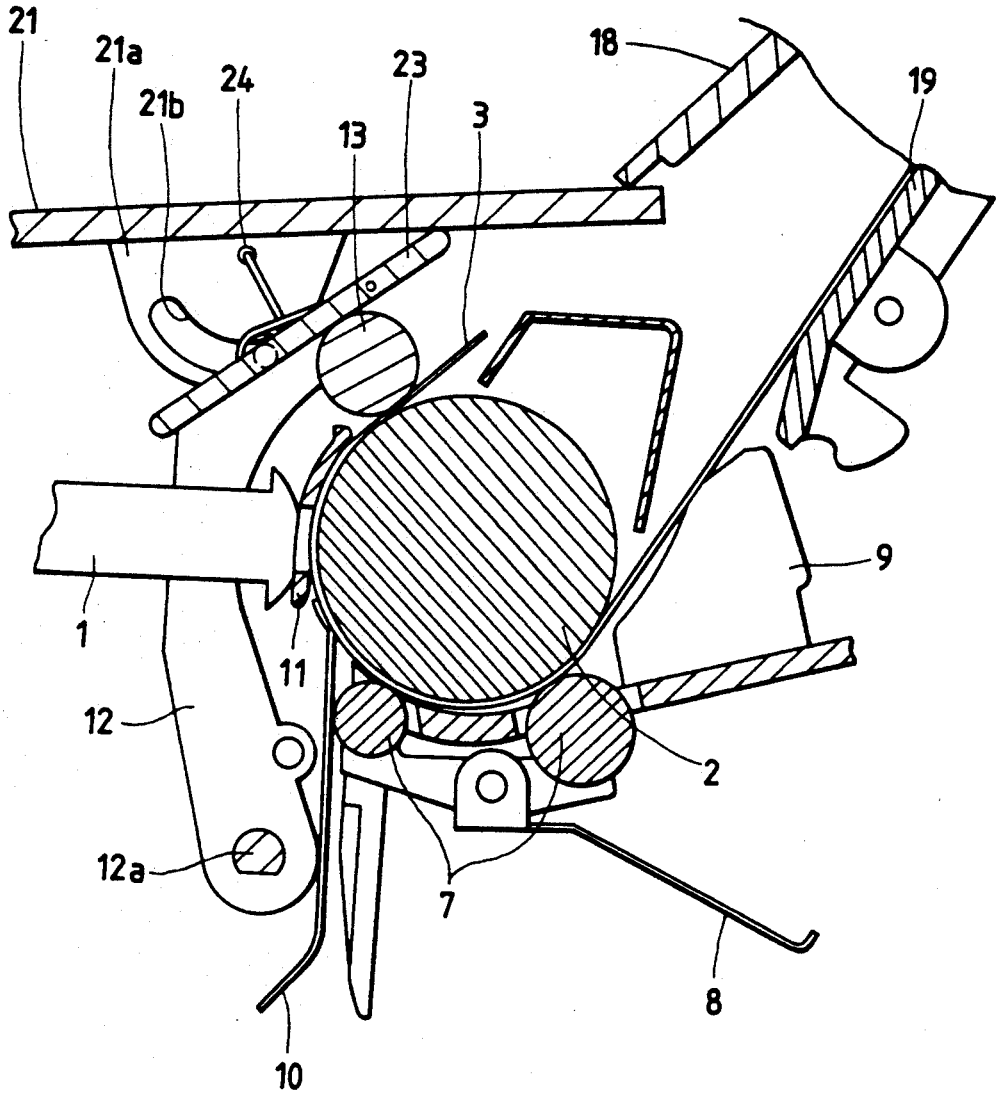
FIG. 10 is an enlarged fragmentary vertical cross-sectional view of the printing device according to the first embodiment, showing the sheet presser roller in an operative position.

The printing device according to the second embodiment operates as follows: As shown in FIG. 9, the recording sheet 3 is inserted along the sheet stand 19 and the sheet guide 9 between the platen 2 and the sheet feed idler rollers 7, and is sandwiched between the platen 2 and the sheet feed idler rollers 7. When the platen 2 rotates, the inserted recording sheet 3 is fed along the outer circumference of the platen 2 into a position between the platen 2 and the sheet presser roller 13 while being guided by the sheet presser 10 and the sheet holder 11. At this time, the sheet presser roller 13 is in the inoperative position away from the platen 2, and the flap 23 guides the recording sheet 3 as it is fed around the platen 2. After the recording sheet 3 is thus placed around the platen 2, the support arms 12 are turned clockwise toward the platen 2, as shown in FIG. 10, and the sheet presser roller 13 presses the recording sheet 3 against the platen 2.

With the recording sheet 3 held against the platen 2 by the sheet feed roller 13, the print wires of the print head 1 are selectively actuated to press the ink ribbon against the recording sheet 3, thereby printing desired characters on the recording sheet 3. During the printing operation, the sheet presser roller 13 is in the operative position, and the lower edge of the flap 23 is biased toward the sheet presser roller 13 by the springs 24 and the upper edge thereof is biased against the upper cover 21 by the springs 24. Therefore, the space above the print head 1 is closed by the outer casing 16, the upper cover 21, the flap 23, the sheet presser roller 13, and the platen 2. The closure mechanism however does not prevent the recording sheet 3 from being fed smoothly around the platen 2 without interference.

When the recording sheet 3 is inserted in the printing device and placed around the platen 2, the recording sheet 3 is guided by the flap 23 so as not to engage the upper cover 17. The recording sheet 3 can thus be fed along reliably and smoothly without a jam. While the print head 1 is in operation, impact noise is produced when the print wires of the print head 1 strike the platen 2 through the ink ribbon and the recording sheet 3. However, since the space above the print head 1 and below the upper cover 17 is closed by the outer casing 16, the upper cover 21, the flap 23, the sheet presser roller 13, and the platen 2, as described above, the produced impact noise is substantially prevented from leaking out of the outer casing 16 and the upper cover 17. Therefore, the level of noise outside the printing device is greatly reduced.

Figure 11:
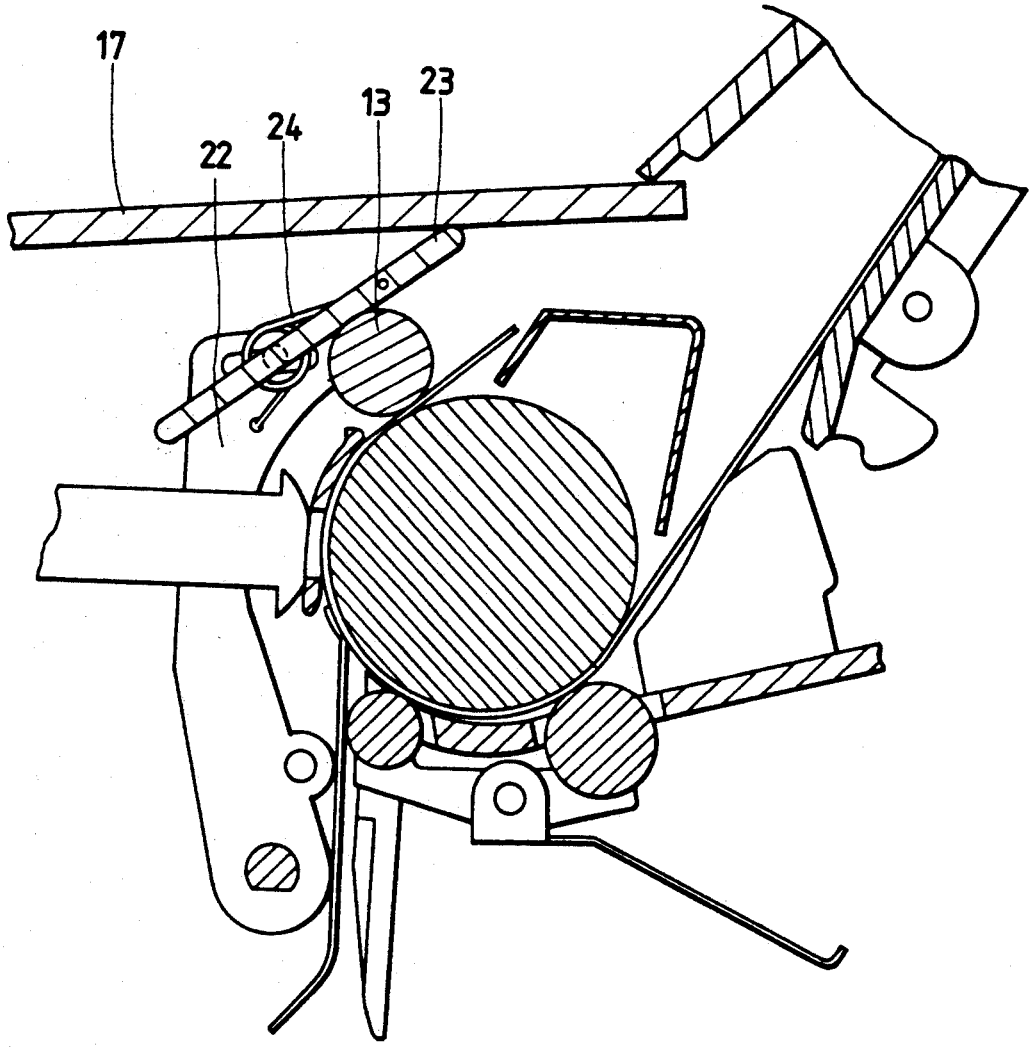
FIG. 11 is an enlarged fragmentary vertical cross-sectional view of a modification of the printing device according to the second embodiment.

In the second embodiment, the flap 23 is supported on the lugs 21*a* projecting downwardly from the upper cover 21. However, as shown in FIG. 11, the flap 23 may slidably and angularly movably supported on the support arms 12. The flap 23 may alternatively be supported on the chassis 6 or the outer casing 16.

Figure 12:
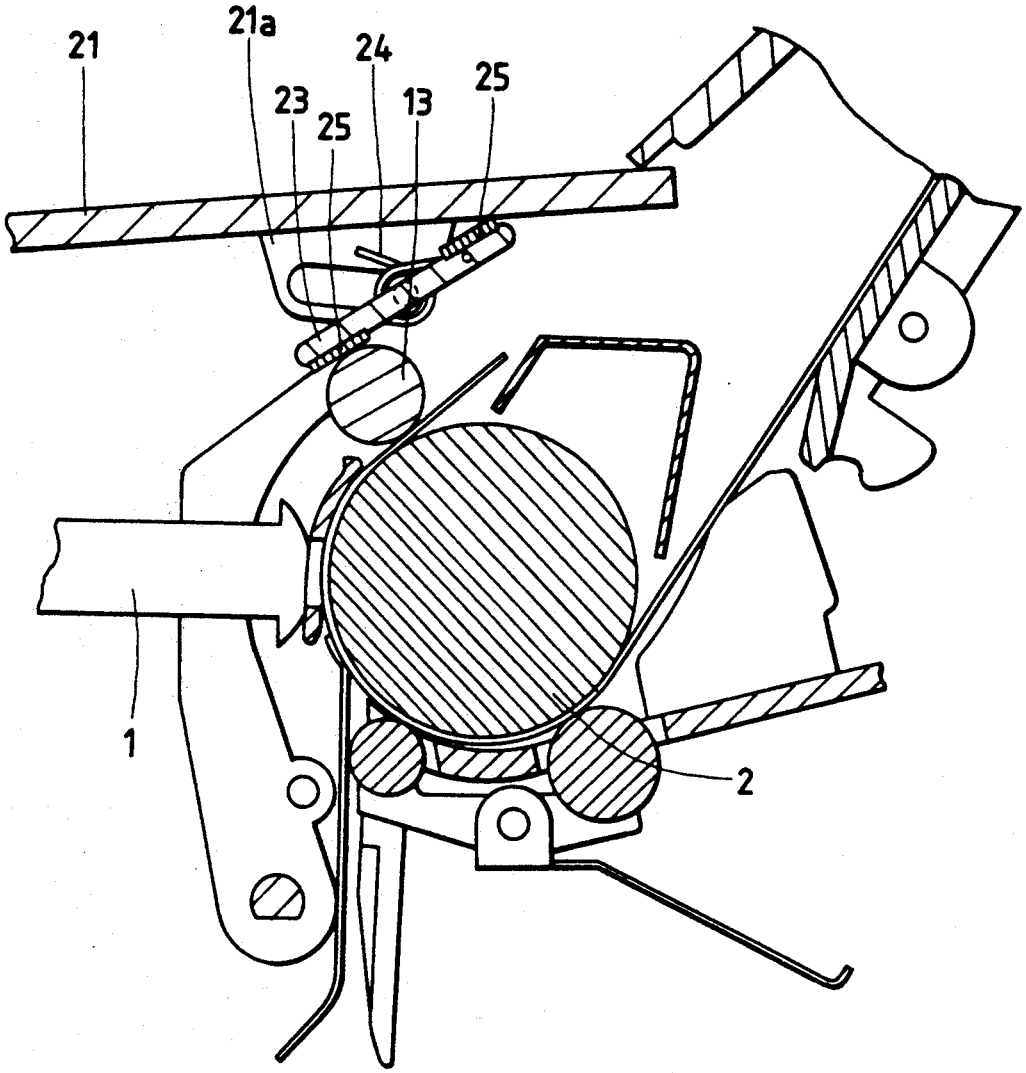
FIG. 12 is an enlarged fragmentary vertical cross-sectional view of another modification of the printing device according to the second embodiment.

When the sheet presser roller 13 is displaced between the operative and inoperative positions, the upper edge of the flap 23 slides against the lower surface of the upper cover 17 and also against the sheet presser roller 13. Preferably, the upper cover 21 and the flap 23 should be made of a synthetic resin material, and the sheet presser roller 13 of a metallic material that has a lower coefficient of friction than that of the synthetic resin material. As shown in FIG. 12, slide members 25 such as of felt may be mounted on the flap 23 for smooth sliding contact with the upper cover 21 and the sheet presser roller 13. Alternatively, the upper edge of the flap 23 may be coated with a fluoroplastic layer for smooth sliding contact with the upper cover 17. Such a modification permits the sheet presser roller 13 to smoothly switch between the operative and inoperative positions while at the same time keeping the space above the print head 1 fully closed against noise leakage.

Although certain preferred embodiments of the present invention have been shown and described in detail, it should be understood that various changes and modifications may be made therein without departing from the scope of the appended claims.

We claim as our invention:

1. A printing device comprising:
a housing;
a print head for printing a recording sheet, said print head being disposed in said housing;
a platen for supporting the recording sheet;
a sheet presser member for pressing the recording sheet against said platen; and
a sound insulating wall disposed inside said housing in such a manner that said sound insulating wall is located at the same side as a printing surface of said recording sheet so as to abut said sheet presser member, said sound insulating wall having an edge held so as to abut an inner surface of said housing.

2. A printing device comprising:
a housing;
a print head for printing a recording sheet, said print head being disposed in said housing;
a platen for supporting the recording sheet;
s sheet presser member for pressing the recording sheet against said platen;
a support member angularly movably supported on said housing, said sheet presser member being angularly movably supported on said support member;
a sound insulating wall disposed within said housing and angularly movably supported on said support member; and
biasing means for normally biasing one edge of said sound insulating wall against an inner surface of said housing.

3. A printing device according to claim 2, further including a slide member mounted on said edge of said sound insulating wall and held in sliding contact with said housing.

4. A printing device comprising:
a housing;
a print head for printing a recording sheet, said print head being disposed in said housing;
a platen for supporting the recording sheet;
a sheet presser member for pressing the recording sheet against said platen;
a support member angularly movably supported on said housing, said sheet presser member being angularly movably supported on said support member;
a sound insulating wall angularly movably disposed inside said housing in such a manner that said sound insulating wall is located at the same side as a printing surface of said recording sheet; and
biasing means for normally biasing opposite edges of said sound insulating wall against an inner surface of said housing and said sheet presser member, respectively.

5. A printing device according to claim 4, further comprising at least one pin by which said sound insulating wall is angularly movably supported on said housing.

6. A printing device according to claim 4, further comprising at least one pin by which said sound insulating wall is angularly movably supported on said support member.

7. A printing device according to claim 4, further including slide members mounted respectively on said opposite edges of the sound insulating wall and held in sliding contact with said housing and said sheet presser member, respectively.

8. A printing device comprising:

a housing;

a print head for printing a recording sheet, said print head being disposed in said housing;

a platen for supporting the recording sheet;

a sheet presser member for pressing the recording sheet against said platen;

a support member angularly movably supported on said housing, said sheet presser member being angularly movably supported on said support member so that said sheet presser member is detachably supported against said platen;

a sound insulating wall angularly movably disposed inside said housing in such a manner that said sound insulating wall abuts said sheet presser member at an opposite side of its contacting portion where said sheet presser member contacts said recording sheet, said sound insulating wall having an edge held closely to an inner surface of said housing.

9. A printing device comprising:

a housing;

a print head for printing a recording sheet, said print head being disposed in said housing;

a platen for supporting the recording sheet;

a sheet presser member for pressing the recording sheet against said platen;

a support member angularly movably supported on said housing, said sheet presser member being angularly movably supported on said support member so that said sheet presser member is detachably supported against said platen;

a sound insulating wall angularly movably disposed inside said housing in such a manner that said sound insulating wall is located at the same side as a printing surface of said recording sheet so as to abut said sheet presser member at an opposite side of its contacting portion where said sheet presser member contacts said recording sheet, said sound insulating wall having an edge held to abut an inner surface of said housing.

10. A printing device comprising:

a housing;

a print head for printing a recording sheet, said print head being disposed in said housing;

a platen for supporting the recording sheet;

a sheet presser member for pressing the recording sheet against said platen;

a support member angularly movably supported on said housing, said sheet presser member being angularly movably supported on said support member so that said sheet presser member is detachably supported against said platen;

a sound insulating wall angularly movably disposed inside said housing in such a manner that said sound insulating wall is located at the same side as a printing surface of said recording sheet, said sound insulating wall having an edge held to abut an inner surface of said housing; and biasing means for normally biasing said sound insulating wall toward a surface of said sheet presser opposite to its contacting portion where said sheet presser member contacts said recording sheet.

* * * * *